US007624726B2

(12) United States Patent
Wood

(10) Patent No.: US 7,624,726 B2
(45) Date of Patent: Dec. 1, 2009

(54) VALVE FOR COMPRESSED GAS GUN

(75) Inventor: Michael J. Wood, Newman, GA (US)

(73) Assignee: Kee Action Sports I LLC, Sewell, NJ (US)

( * ) Notice: Subject to any disclaimer, the term of this patent is extended or adjusted under 35 U.S.C. 154(b) by 546 days.

(21) Appl. No.: 11/180,506

(22) Filed: Jul. 13, 2005

(65) Prior Publication Data

US 2006/0037597 A1 Feb. 23, 2006

Related U.S. Application Data

(60) Provisional application No. 60/587,337, filed on Jul. 13, 2004.

(51) Int. Cl.
*F41B 11/00* (2006.01)

(52) U.S. Cl. ..... 124/73; 124/74; 124/75; 124/76; 124/77

(58) Field of Classification Search ..... 124/71–77; 89/7

See application file for complete search history.

(56) References Cited

U.S. PATENT DOCUMENTS

| | | | |
|---|---|---|---|
| 645,932 | A | 3/1900 | Beck et al. |
| 1,191,877 | A | 7/1916 | Dickey |
| 1,441,975 | A | 1/1923 | Edelin |
| 1,503,913 | A | 8/1924 | Miles |
| 2,283,300 | A | 5/1942 | Vincent |
| 2,357,951 | A | 9/1944 | Hale |
| 2,550,887 | A | 5/1951 | Tratsch |
| 2,594,240 | A | 4/1952 | Wells |
| 2,618,254 | A | 11/1952 | Wells |
| 2,881,752 | A | 4/1959 | Blahnik |
| 3,204,625 | A | 9/1965 | Shepherd |
| 3,572,310 | A | 3/1971 | Chiba |
| 3,612,026 | A | 10/1971 | Vadas |
| 3,628,557 | A | 12/1971 | Newborough |
| 3,693,654 | A | 9/1972 | Runkle |
| 3,741,189 | A | 6/1973 | Kester et al. |
| 3,888,159 | A | 6/1975 | Elmore et al. |
| 3,951,038 | A | 4/1976 | Van Langenhoven |
| 4,004,566 | A | 1/1977 | Fischer |
| 4,128,209 | A | 12/1978 | Johnson |
| 4,411,189 | A | 10/1983 | Miller |
| 4,531,503 | A | 7/1985 | Shepherd |
| 4,616,622 | A | 10/1986 | Milliman |
| 4,770,153 | A | 9/1988 | Edelman |

(Continued)

FOREIGN PATENT DOCUMENTS

| | | |
|---|---|---|
| EP | 0 467 089 | 10/1995 |

(Continued)

*Primary Examiner*—Troy Chambers
(74) *Attorney, Agent, or Firm*—Volpe and Koenig, P.C.

(57) ABSTRACT

A valve body is provided defining housing a moveable valve spool having a first end and a second end. The valve spool forms a gas balance chamber within the valve body. The valve spool has an end for closing an opening in the valve body. A channel running through the valve spool provides communication with the second end of the valve spool and the gas balance chamber. The second end of the spool valve is adapted to have an effective surface area greater than the effective surface area of the gas balance chamber.

6 Claims, 18 Drawing Sheets

U.S. PATENT DOCUMENTS

| | | | |
|---|---|---|---|
| 4,819,610 | A | 4/1989 | Lacam et al. |
| 4,936,282 | A | 6/1990 | Dobbins et al. |
| 5,062,454 | A | 11/1991 | Ichihashi et al. |
| 5,063,905 | A | 11/1991 | Farrell |
| 5,257,614 | A | 11/1993 | Sullivan |
| 5,280,778 | A | 1/1994 | Kotsiopoulos |
| 5,333,594 | A | 8/1994 | Robinson |
| 5,337,655 | A | 8/1994 | Bielfeldt |
| 5,339,791 | A | 8/1994 | Sullivan |
| 5,494,024 | A | 2/1996 | Scott |
| 5,503,137 | A | 4/1996 | Fusco |
| 5,515,838 | A | 5/1996 | Anderson |
| 5,598,871 | A | 2/1997 | Sturman et al. |
| 5,613,483 | A | 3/1997 | Lukas et al. |
| 5,669,369 | A | 9/1997 | Scott |
| 5,704,342 | A | 1/1998 | Gibson et al. |
| 5,727,538 | A | 3/1998 | Ellis |
| 5,769,066 | A | 6/1998 | Schneider |
| 5,878,736 | A | 3/1999 | Lotuaco, III |
| 5,913,303 | A | 6/1999 | Kotsiopoulos |
| 5,957,119 | A | 9/1999 | Perry |
| 6,003,547 | A | 12/1999 | Tippmann, Jr. |
| 6,024,077 | A | 2/2000 | Kotsiopoulos |
| 6,065,460 | A | 5/2000 | Lotuaco, III |
| 6,138,656 | A | 10/2000 | Rice et al. |
| 6,343,599 | B1 | 2/2002 | Perrone |
| 6,360,736 | B1 | 3/2002 | Juan |
| 6,474,326 | B1 | 11/2002 | Smith et al. |
| 6,550,468 | B1 | 4/2003 | Tippmann, Jr. |
| 6,557,542 | B1 | 5/2003 | Orr |
| 6,561,176 | B1 | 5/2003 | Fujimoto et al. |
| 6,601,780 | B1 | 8/2003 | Sheng |
| 6,637,421 | B2 | 10/2003 | Smith et al. |
| 6,644,295 | B2 | 11/2003 | Jones |
| 6,658,982 | B2 | 12/2003 | Cherry |
| 6,708,685 | B2 | 3/2004 | Masse |
| 6,732,726 | B2 | 5/2004 | Ho |
| 6,763,822 | B1 | 7/2004 | Styles |
| 6,807,959 | B1 | 10/2004 | Murdock et al. |
| 6,810,871 | B2 | 11/2004 | Jones |
| 6,832,605 | B2 | 12/2004 | Farrell |
| 6,860,259 | B2 | 3/2005 | Rice et al. |
| 6,889,681 | B1 | 5/2005 | Alexander et al. |
| 6,907,901 | B2 | 6/2005 | Holmes et al. |
| 6,915,792 | B1 | 7/2005 | Sheng |
| 2001/0042543 | A1 | 11/2001 | Perrone |
| 2002/0088449 | A1 | 7/2002 | Perrone |
| 2002/0096164 | A1 | 7/2002 | Perrone |
| 2003/0024520 | A1 | 2/2003 | Dobbins |
| 2003/0024521 | A1 | 2/2003 | Smith et al. |
| 2003/0047174 | A1 | 3/2003 | Tiberius et al. |
| 2003/0047175 | A1 | 3/2003 | Farrell |
| 2003/0079731 | A1 | 5/2003 | Dobbins |
| 2003/0226555 | A1 | 12/2003 | Reible |
| 2004/0065310 | A1 | 4/2004 | Masse |
| 2004/0084040 | A1 | 5/2004 | Jones |
| 2004/0134476 | A1 | 7/2004 | Smith et al. |
| 2004/0144012 | A1 | 7/2004 | Adams |
| 2004/0216728 | A1 | 11/2004 | Jong |
| 2005/0115550 | A1 | 6/2005 | Jones |
| 2006/0011184 | A1 | 1/2006 | Jacobsson |
| 2006/0011185 | A1 | 1/2006 | Jacobsson |

FOREIGN PATENT DOCUMENTS

| | | | | |
|---|---|---|---|---|
| EP | 1 197 723 | A2 | | 4/2002 |
| EP | 1 209 435 | A2 | | 5/2002 |
| EP | 1 209 435 | A3 | | 11/2002 |
| EP | 1 197 723 | A3 | | 3/2003 |
| GB | 2 193 797 | | | 2/1988 |
| GB | 2 228 067 | | | 8/1990 |
| GB | 2 258 913 | | | 2/1993 |
| GB | 2 313 655 | | | 12/1997 |
| JP | 61149676 | A | * | 7/1986 |
| JP | 01247876 | A | * | 10/1989 |
| JP | 03249485 | A | * | 11/1991 |
| JP | 2002317879 | A | * | 10/2002 |
| SU | 1384803 | A | * | 3/1988 |

* cited by examiner

VALVE FOR COMPRESSED GAS GUN

CROSS REFERENCE TO RELATED APPLICATION(S)

This application claims the benefit of U.S. Provisional Application No. 60/587,337, filed Jul. 13, 2004, which is incorporated by reference as if fully set forth herein.

FIELD OF INVENTION

This invention relates to a valve assembly for a compressed gas gun, and a compressed gas gun incorporating the valve assembly.

BACKGROUND

Compressed gas guns, such as paintball markers used in the sport of paintball, using compressed gas or air for firing projectiles are well known. As used herein, compressed gas gun refers to any gun or similar launching mechanism for use in sport wherein a projectile is fired via the force of compressed gas, and includes paintball markers. As used herein, projectiles refers to both paintballs, and other projectiles used in sport and game play.

There are two basic mechanisms employed in compressed gas guns for firing a projectile during a firing operation. Loading a projectile in the breech of a compressed gas gun involves a bolt that reciprocates from a loading position, allowing a projectile into the breech, to a firing position.

A valving system is employed to release compressed gas from a source of compressed gas to fire the projectile from the gun. The valving system generally utilizes a hammer or ram that moves under spring force or pneumatic force upon actuation of a trigger, to strike the stem of a poppet to Nelson-style valve to allow compressed gas from a compressed gas chamber to flow through the valve body. The compressed gas flows through the opened valve body and through an aperture in the bolt, thereby firing a projectile in the breech of the paintball marker from the chamber and down the barrel. While other valving systems are employed, generally, all involve directing compressed gas under pressure to fire a projectile from the compressed gas gun. A typical prior art valve Pneumatic guns of the "stacked" "over/under" or "two tube" variety for discharging projectiles such as paintballs are under the trademarks 32 DEGREES, EMPIRE, DIABLO, and INTIMIDATOR. In these arrangements, the upper chamber houses the bolt, and the lower chamber houses the valve assembly and hammer or ram, which is generally formed as a piston with a striker at the end facing the valve. The hammer or ram is attached by a mechanical linkage such as a pin to the bolt, so that both move together. A spring is used to bias the hammer toward the valve assembly.

In many cases, compressed gas guns utilize a poppet valve as the firing valve, that is, as the valve that releases compressed gas from a compressed gas source to fire a projectile from the gun. A typical prior art poppet valve 300 and hammer 306 arrangement is shown in FIG. 18. A valve spring 302 is provided, biasing the seat 304 of the poppet valve 300 closed. The hammer 306 is held in a cocked or ready position by a sear 308 that pivots to engage a portion of the hammer 306. A trigger 310 moves the sear 308, allowing the hammer 306 to spring forward under the bias of hammer spring 314 and contact the stem 312 of the poppet valve 300. When the hammer 306 contacts the stem 312, the seat 304 moves away from the valve body, opening the valve, and allowing compressed gas to flow through the valve body. These types of compressed gas guns move the hammer back to the loading or start position by "blow back," that is, some of the air from a high pressure chamber returns the hammer to the cocked or loading position, thus "blowing" the hammer back to the starting position.

Some compressed gas guns are termed "electronic" compressed gas guns, and operate the hammer pneumatically. The hammer is formed as a pneumatic piston, and is disposed in a lower chamber of a compressed gas gun such as a paintball marker. Electronic compressed gas guns have electronics for controlling at least one solenoid valve, which directs compressed gas from a compressed gas source to the rear end or forward end of the piston, to operate the hammer. Such electronic guns still rely upon the hammer striking a poppet style valve assembly to fire a projectile from the guns.

As can be appreciated, the force of the valve spring must be strong to return the seat of the poppet valve to a closed position. In addition the force of the hammer spring or the pneumatic force moving the hammer must be strong enough overcome the valve spring. This arrangement creates inefficiencies, and wastes compressed gas.

It would be advantageous to have a valve assembly for a compressed gas gun where the valve assembly may be opened using less force than in known valve assemblies.

SUMMARY

Briefly stated, the present invention is directed to a novel valve assembly for a compressed gas gun. The novel valve assembly can be utilized in either an open bolt or closed bolt compressed gas gun.

A valve body is provided defining an interior space having a first end with a channel therethrough and an opposite second end with an opening therethrough, and a valve aperture intermediate the first end and the second end. A valve spool includes a portion disposed within the housing, and forming a gas balance chamber within the interior space adjacent the first end of the valve body. The valve spool has a second end opposite the first end positioned adjacent the outer side of the second end of the valve body, the second end of the valve spool sized to close the opening in the second end of the valve body. A channel running through the valve spool provides communication with the second end of the valve spool and the gas balance chamber. The second end of the spool valve is adapted to have an effective surface area greater than the effective surface area of the gas balance chamber.

A compressed gas gun employing the valve assembly of the present invention is also disclosed.

BRIEF DESCRIPTION OF THE DRAWING(S)

Additional objects and advantages of the present invention will become apparent to those ordinarily skilled in the pertinent arts upon reading the following detailed description of a particularly preferred embodiment of the invention, which illustrates the best mode contemplated for practicing the invention, taken in conjunction with the accompanying drawings.

DETAILED DESCRIPTION OF THE PREFERRED EMBODIMENT(S)

Figure 1:
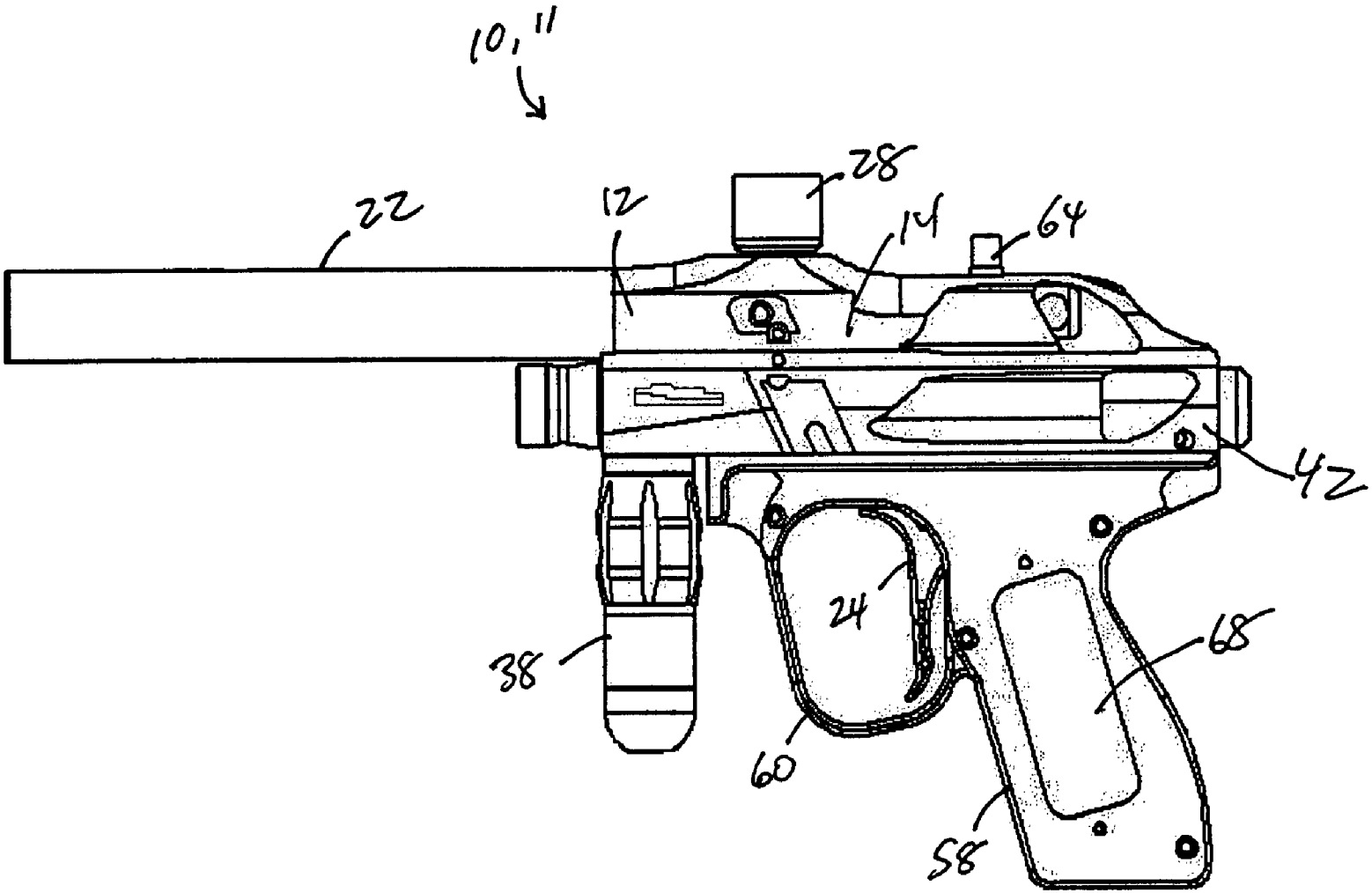
FIG. 1 shows a side view of a compressed gas gun, that may use spring force to move a hammer, or may use pneumatic force to move a hammer.

Certain terminology is used in the following detailed description for convenience only and is not considered limiting. Several embodiments of a valve assembly of the present invention and a compressed gas gun incorporating the valve assembly is disclosed here and in the Figures. For clarity, within this document all reference to the top and bottom of the compressed gas gun and valve assembly will correspond to the compressed gas gun as oriented in FIGS. 1-9. Likewise, all reference to the front or forward portion of said compressed gas gun and valve assembly will correspond to the leftmost part of said gun as viewed in FIGS. 1-9, and all reference to the rear portion of said compressed gas gun and valve assembly will correspond to the rightmost part of said compressed gas gun and valve assembly as viewed in FIGS. 1-9. The words "upper" and "lower" designate directions in the drawings to which reference is made. The words "forward" and "rear" or "rearward" designate directions in the drawings to which reference is made. Additionally, the terms "a" and "one" are defined as including one or more of the referenced item unless specifically noted.

Figure 2:
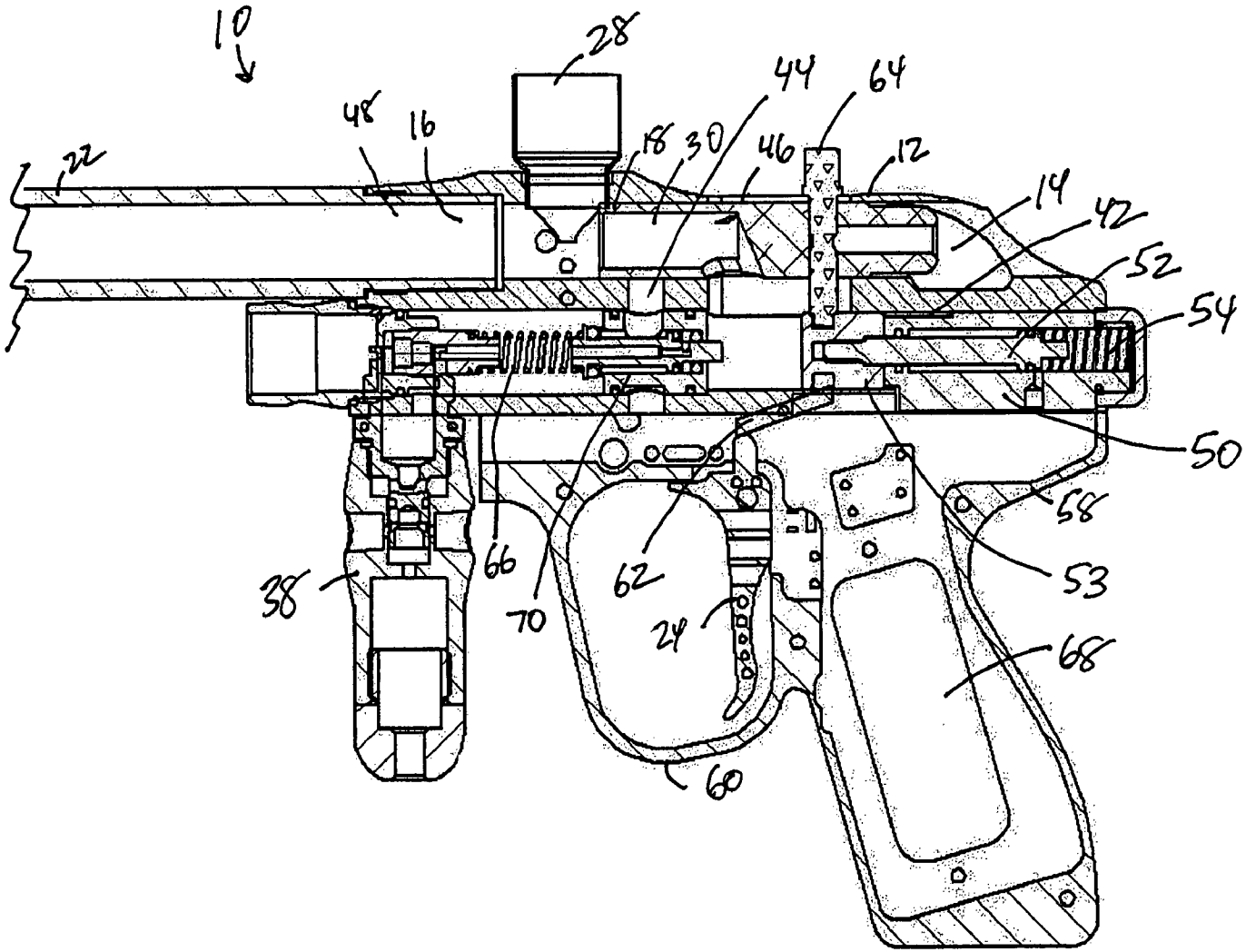
FIG. 2 shows a cross sectional side view of a compressed gas gun including the valve assembly of the present invention, using spring force to move the hammer, with the hammer and bolt in the loading position.
Figure 3:
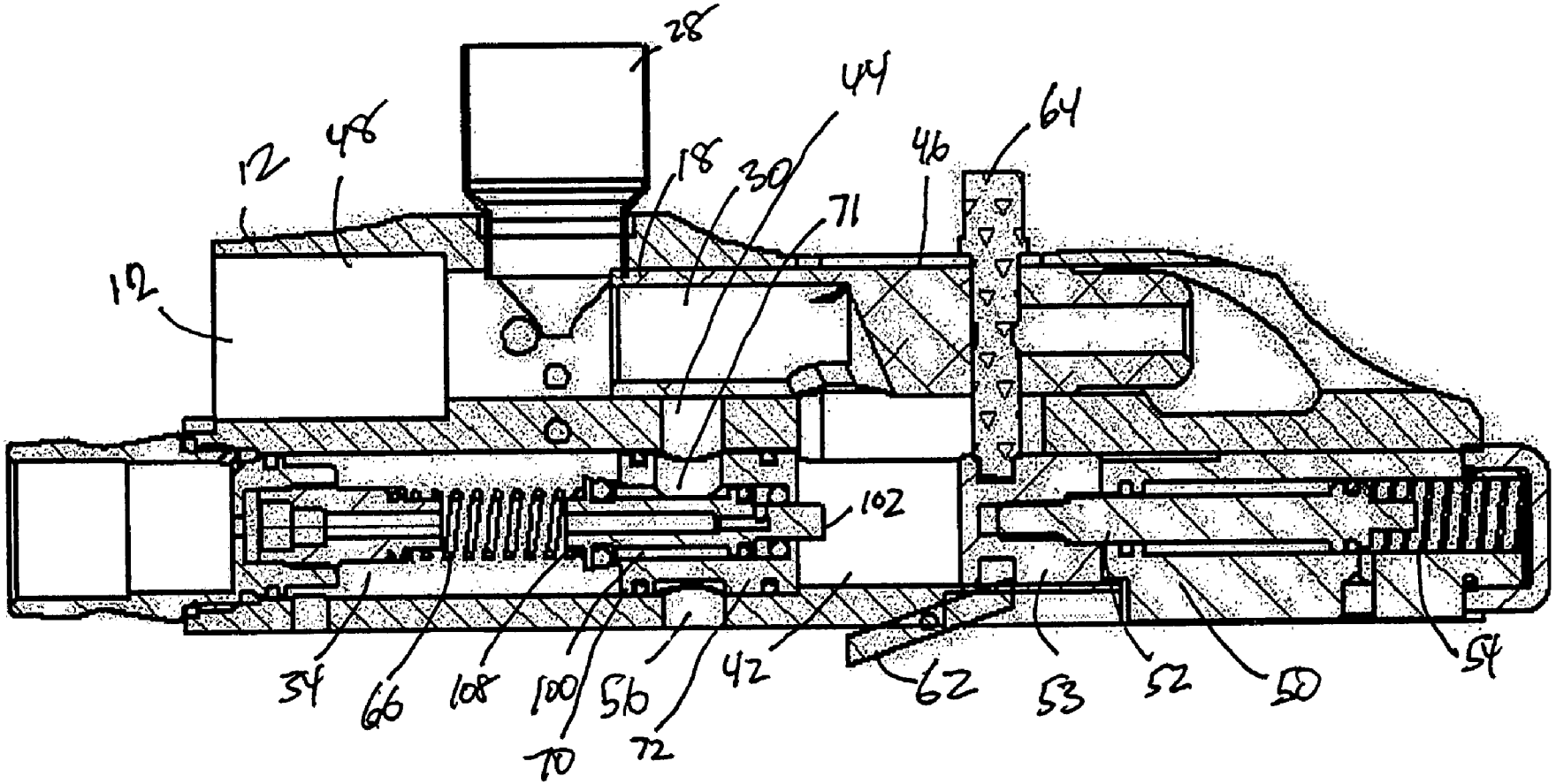
FIG. 3 shows a cross sectional side view of the gun body of the compressed gas gun shown in FIG. 2, with the hammer and bolt in the loading position and the valve assembly of the present invention in the closed position.
Figure 4:
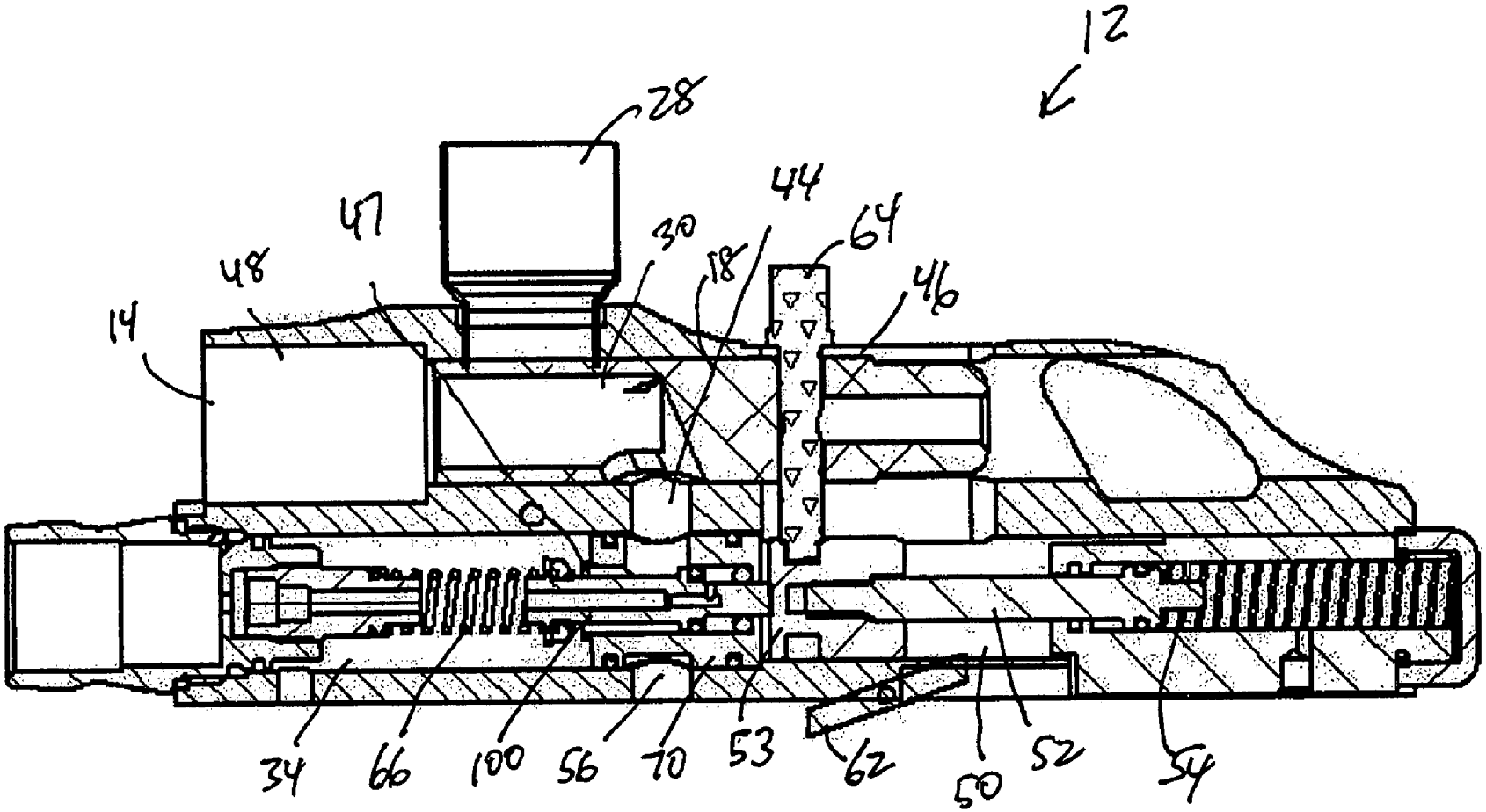
FIG. 4 shows a cross sectional side view of the gun body of a compressed gas gun shown in FIG. 3, with the hammer and bolt in the firing position and the valve assembly of the present invention in the open position.

Illustrative compressed gas guns are shown in FIGS. 1-7, of the "over/under," "stacked," or "two tube" type, having an upper chamber 14 and a lower chamber 42. FIGS. 2-4 show an "over/under" or "two tube" type of compressed gas gun 10, incorporating the valve assembly 70 of the present invention, and operating with a hammer 52 moveable by a hammer spring 54. The hammer 52 may be formed having a hammer striker 53 at its forward end. The illustrative compressed gas gun 10 comprises a gun body 12 or frame which houses components of the compressed gas gun 10. The gun body 12 includes an upper chamber 14, and a lower chamber 42. An infeed tube 28 is positioned to feed projectiles, such as paintballs, to the breech 16 of the compressed gas gun 10.

The upper chamber 14 includes a breech 16 portion that houses a bolt 18, having a bolt aperture 30 therethrough. The bolt 18 is moveable from a first or loading position adjacent a first or rear end 46 of the breech 16, to a second or firing position adjacent the second or forward end 48 of the breech 16.

The gun body 12 further includes a lower chamber 42, positioned below and parallel to the upper chamber 14. The lower chamber 42 has a first or hammer portion 50. In the embodiment shown in FIGS. 2-4, the lower chamber 42 houses the hammer spring 54 and the hammer 52. In the embodiment shown in FIGS. 5-7, the lower chamber 42 houses a pneumatic chamber 63 for operating the hammer 52. Either configuration may be used in conjunction with the valve assembly 70 of the present invention. The hammer 52 may be formed as a piston, moveable from a first or loading position, to a forward or firing position within the hammer portion 50 of the lower chamber 42.

As shown in FIGS. 2-7, the lower chamber 42 further includes a valve portion 56 housing the valve assembly 70 of the present invention. The lower chamber 42 further includes a high pressure chamber 34, which receives compressed gas (gas under pressure) from a source of compressed gas (not shown) such as a CO2 tank, nitrous tank, or other compressed gas tank as is known in the art. A firing port 44 is provided as a channel providing communication between the upper chamber 14 and lower chamber 42, and most specifically, providing communication between the valve aperture 71 of the valve assembly 70, and the aperture 30 of the bolt 18. The high pressure chamber 34 houses a valve return spring 66, which will be described in greater detail below.

The lower portion of the compressed gas gun 10 further includes a grip frame 58 including a trigger guard 60 and a trigger 32. The trigger 32 is adapted to contact a sear 62, for cocking the hammer 52. The forward portion of the compressed gas gun 10 includes a detachable barrel 22 in communication with the breech 16. The hammer 52 is connected to the bolt 18 via a mechanical linkage 64 running through an opening 20 between the upper chamber 14 and the lower chamber 42, such that when the hammer 52 moves within the lower chamber 42 from a first or ready position to a firing position, the bolt is moved from a loading position, to a firing position. The grip may house electronics, including a microprocessor, and a power source such as a battery, for controlling operations of the gun, such as a firing operation.

There are generally two preferred arrangements for moving the hammer 52 (and thus the bolt 18) from a first or loading position to a firing position. In one embodiment of a compressed gas gun 10, as shown in FIGS. 2-4, the hammer 52 is moved from a first or ready position to a firing position by a hammer spring 54, located rearward the hammer 52 in the hammer portion 50 of the lower chamber 42. The hammer spring 54 biases the hammer 52 to the firing position. The hammer 52 is held against the bias of the hammer spring 54 by sear 62, as shown in FIG. 2-4, until the trigger 24 is pulled, moving the sear 62, which releases the hammer 52. A similar general hammer or ram and spring arrangement is shown in U.S. Pat. No. 5,063,905.

Figure 5:
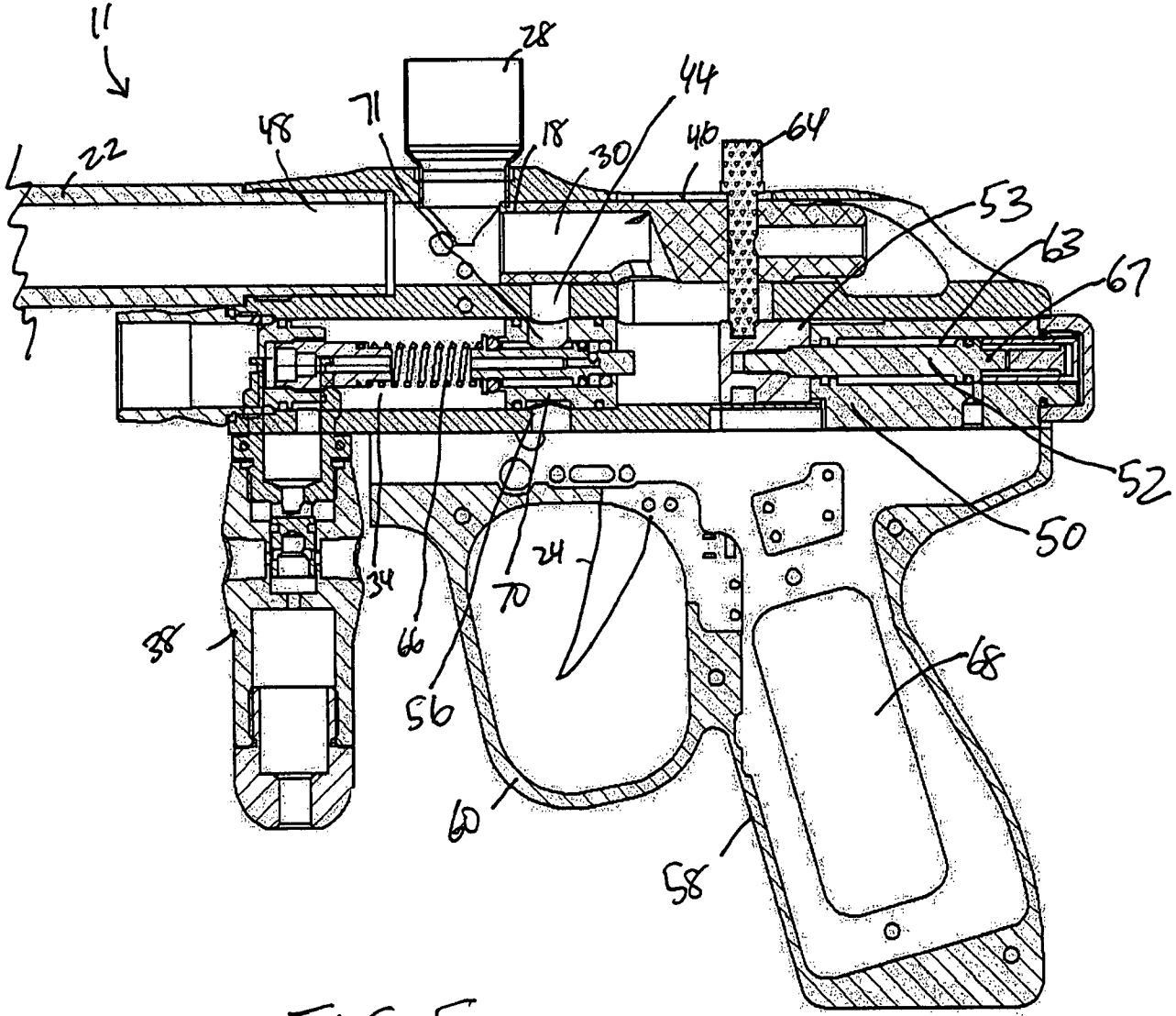
FIG. 5 shows a cross sectional side view of a compressed gas gun including the valve assembly of the present invention, using pneumatics to move the hammer.
Figure 6:
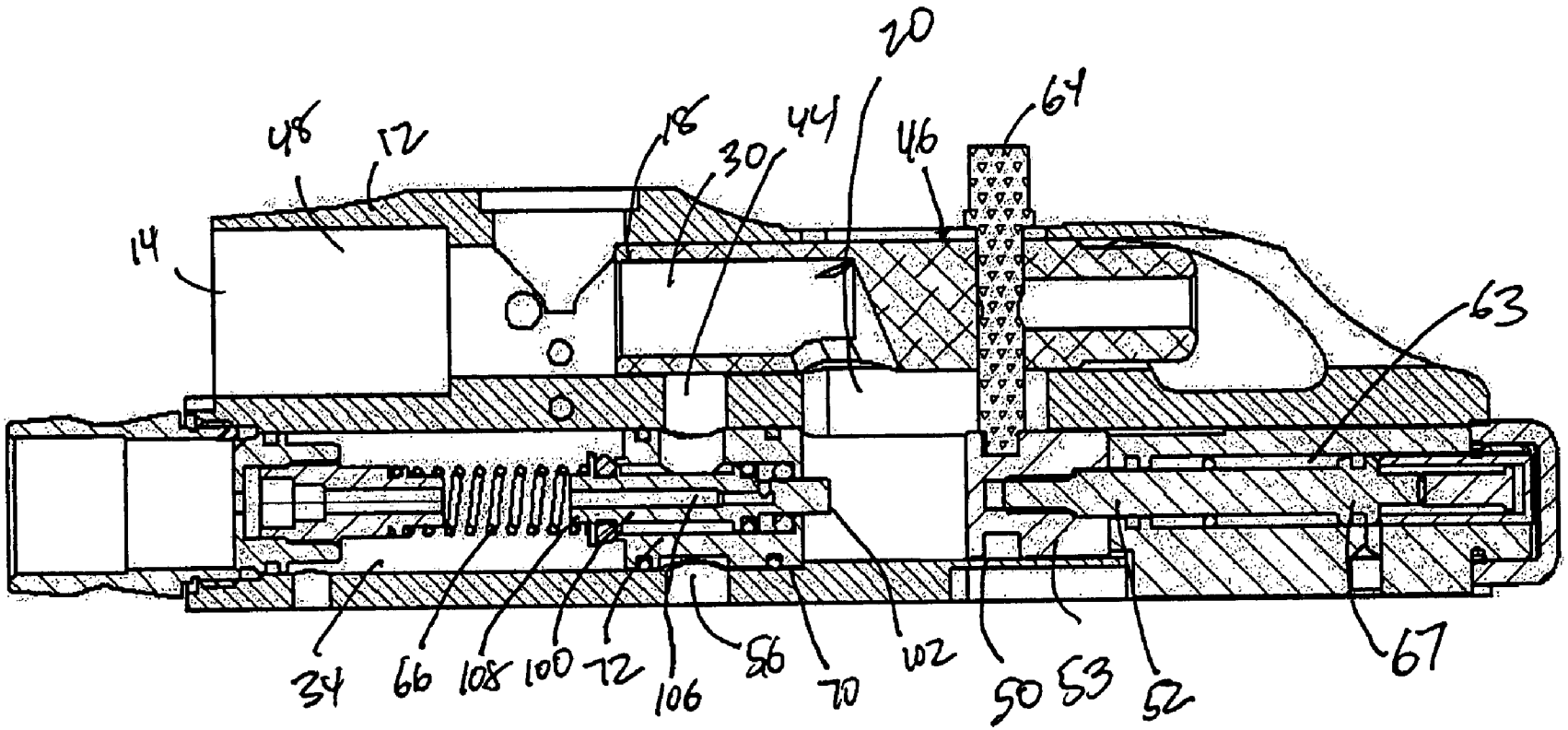
FIG. 6 shows a cross sectional side view of the gun body of the compressed gas gun shown in FIG. 5, using pneumatics to move the hammer, with the hammer and bolt in the loading position, and the valve assembly in the closed position.
Figure 7:
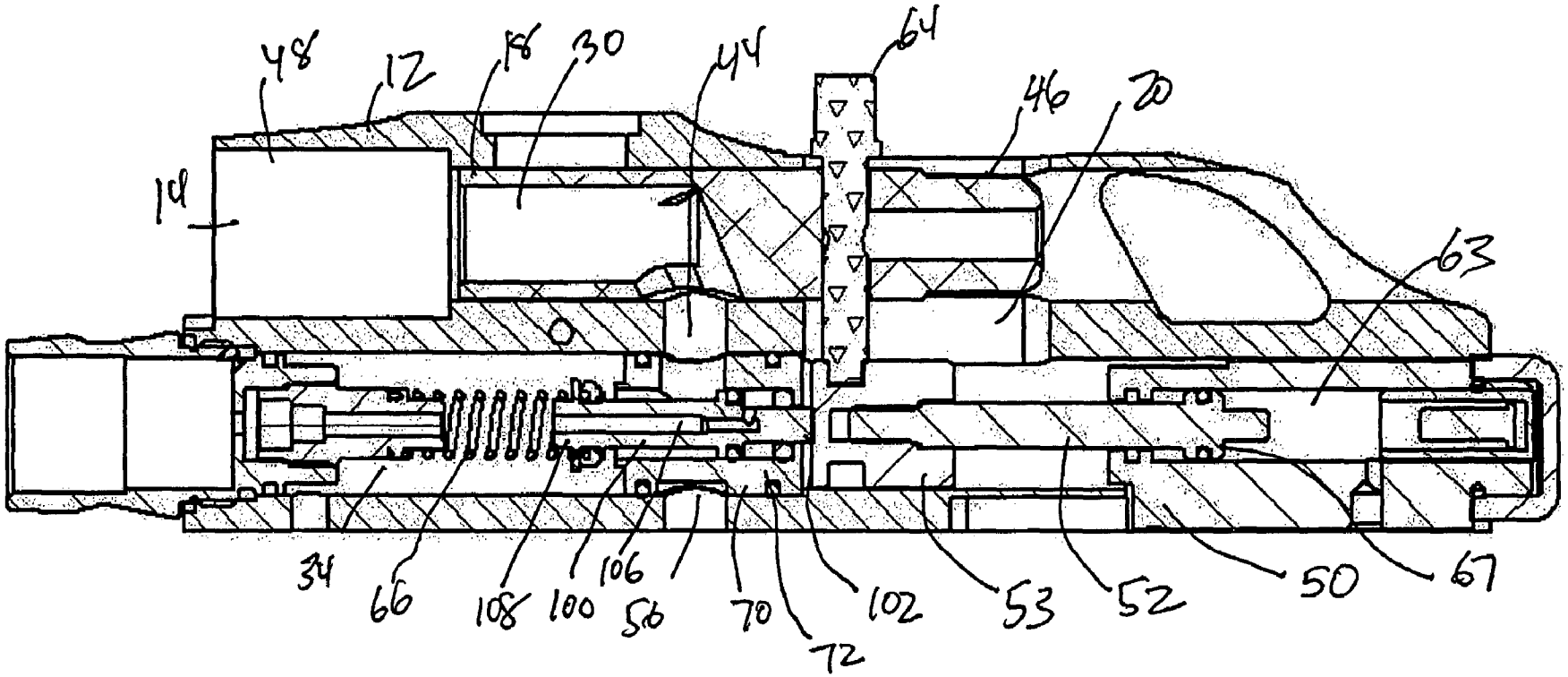
FIG. 7 shows a cross sectional side view of the gun body of a compressed gas gun shown in FIG. 6, with the hammer and bolt in the firing position and the valve assembly of the present invention in the open position.

In an alternate embodiment of a compressed gas gun 11 utilizing the valve assembly 70 of the present invention, the hammer 52 comprises a pneumatic piston, that moves by the application of pneumatic force. As shown in FIGS. 5-7, the hammer portion 50 of the lower chamber 42 may be configured as a pneumatic chamber 63, housing a portion 67 of the hammer 52. Compressed gas from a compressed gas source is routed through ports in the gun body 12 to move the hammer 52. A solenoid valve, such as a three-way or four-way solenoid valve (not shown) may be employed to direct compressed gas from a compressed gas source to move the hammer 52, such as by directing compressed rearward or forward of the portion 67 of the hammer 52. Other arrangements, including combinations of springs and the application of compressed gas, may be used to move the hammer forward and rearward from a loading to a firing position, as are known in the art.

Figure 8:
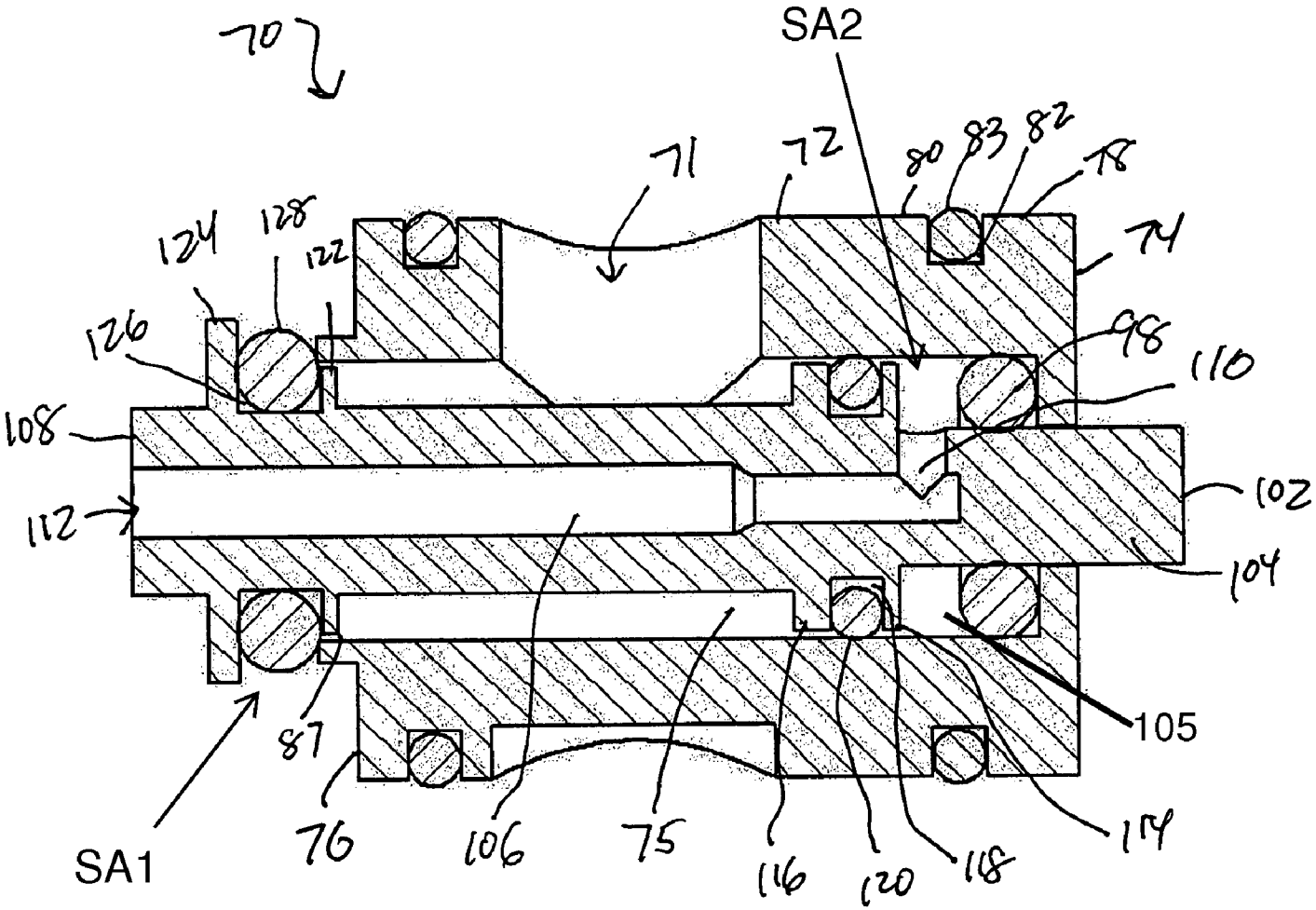
FIG. 8 shows a cross sectional side view of a valve assembly according to the present invention, with the valve assembly and valve spool in the closed position.
Figure 9:
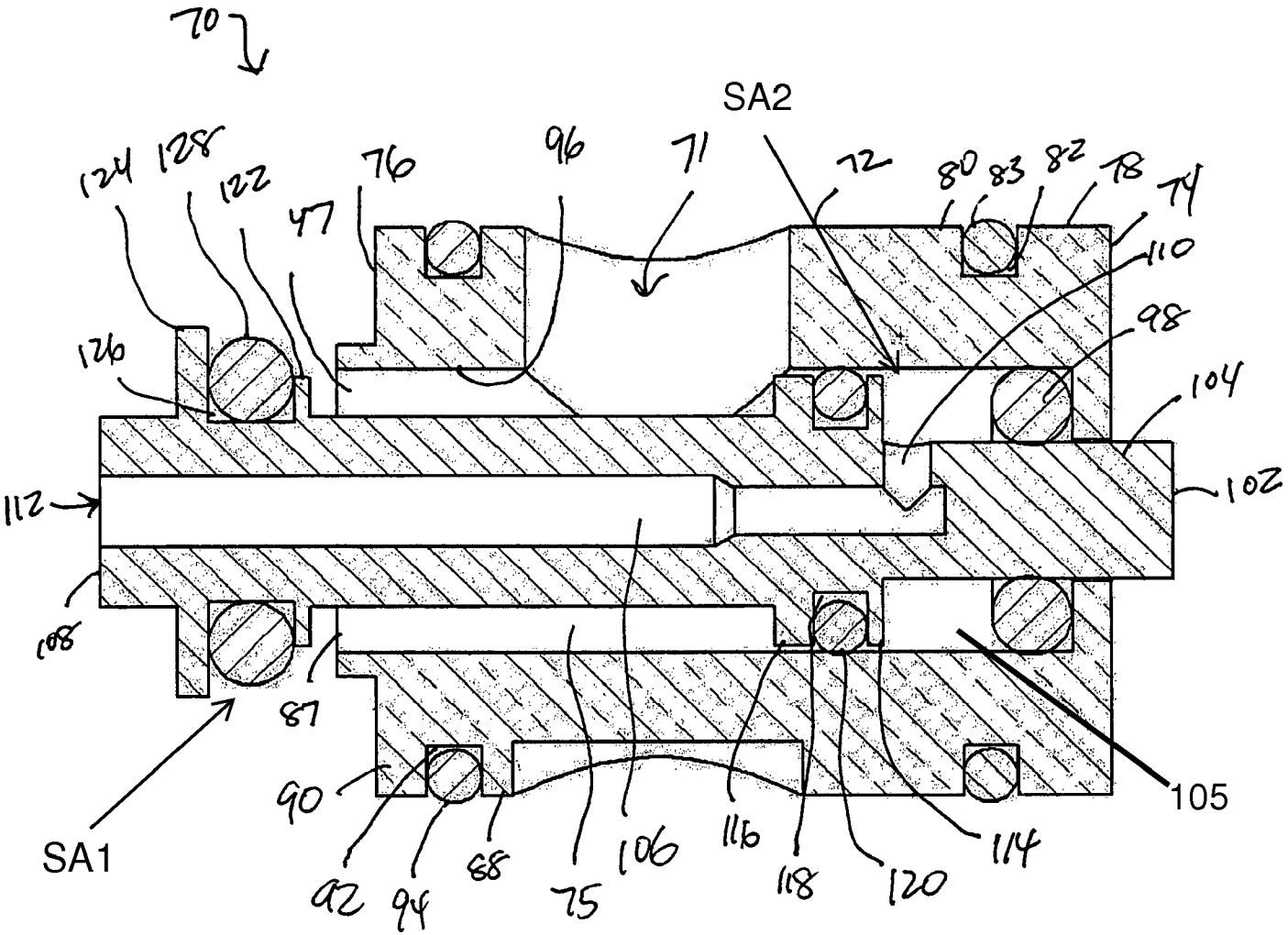
FIG. 9 shows a cross sectional side view of thevalve assembly according to the present invention shown in FIG. 8, with the valve assembly and valve spool in the open position.
Figure 10:
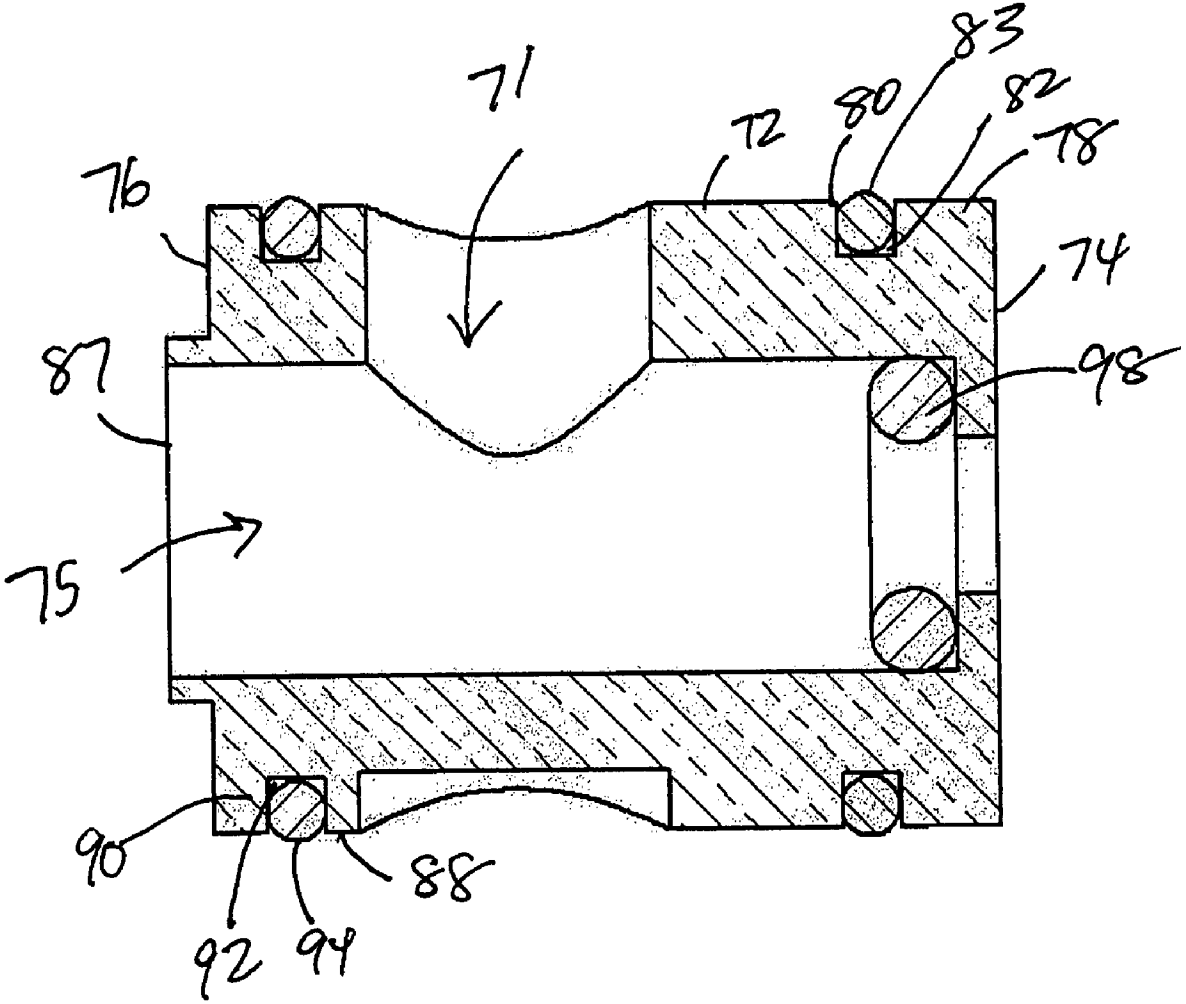
FIG. 10 shows a cross sectional side view of the valve body of the valve assembly of the present invention.

As shown in detail in FIGS. 8-10, the valve assembly 70 of the present invention comprises a valve body 72. The valve body 72 defines an interior space 75. A valve body aperture 71 is provided, that is aligned with firing port 44 when the valve assembly 70 is utilized within a compressed gas gun 10, 11. The valve body 72 has a first or rear end 74 adjacent the hammer portion 50 of the lower chamber 42 with a channel 84 therethrough, and a second or forward end 76 opposite the rear end 74 with an opening 87 therein, adjacent the high pressure chamber 34.

As shown in FIGS. 8-10, the rear end 74 of the valve body 72 has a first rear wall 78 and a second rear wall 80, defining an O-ring receiving space 82. An O-ring 83 is provided in the O-ring receiving space 82. The rear end 74 of the valve body 72 further includes a channel 84. The forward end 76 of the valve body 72 has a first forward wall 88 and a second forward wall 90 defining an O-ring receiving space 92. An O-ring 94 is provided in the O-ring receiving space 92. An O-ring 98 is provided adjacent the inner wall 96 of the valve body 72 adjacent the channel 84 in the rear end 80 of the valve body 72. Alternately, it is appreciated that O-ring receiving space 82 and O-ring receiving space 92 in the valve body 72 may be formed as grooves formed in the valve body 72.

Figure 11:
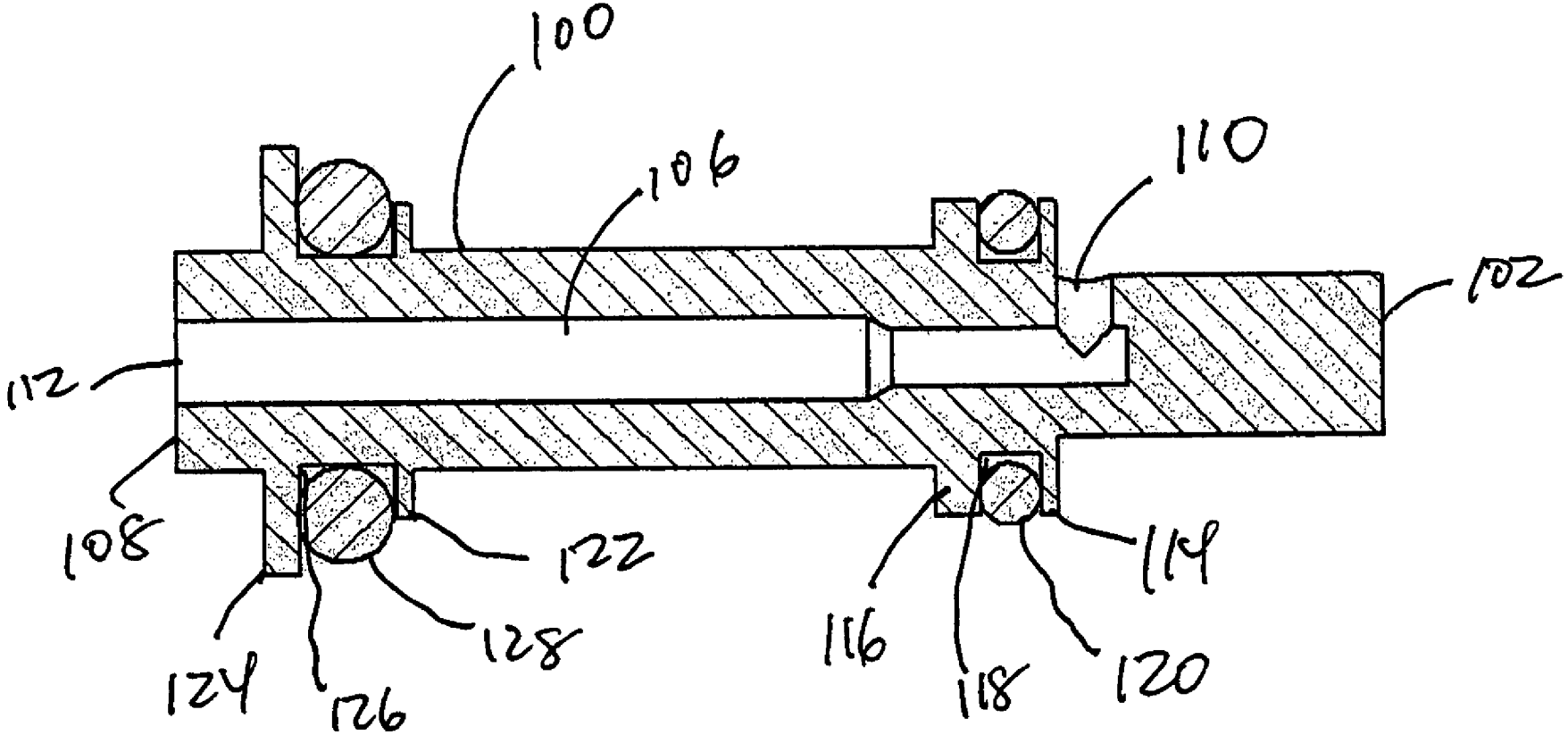
FIG. 11 shows the valve spool of the valve assembly of the present invention.
Figure 12:
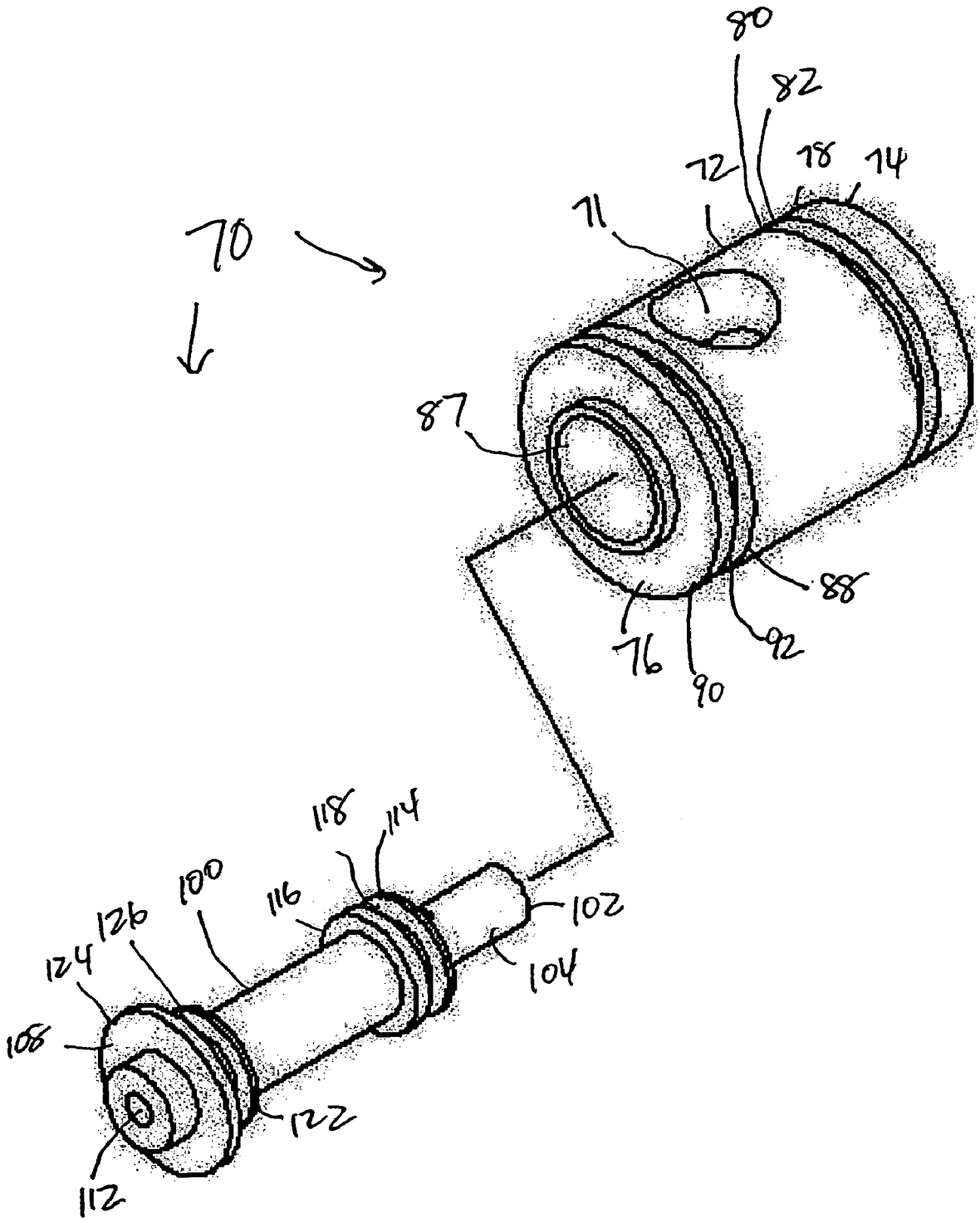
FIG. 12 shows a perspective view of an embodiment of the valve assembly of the present invention, with the valve spool removed from the valve body.
Figure 13:
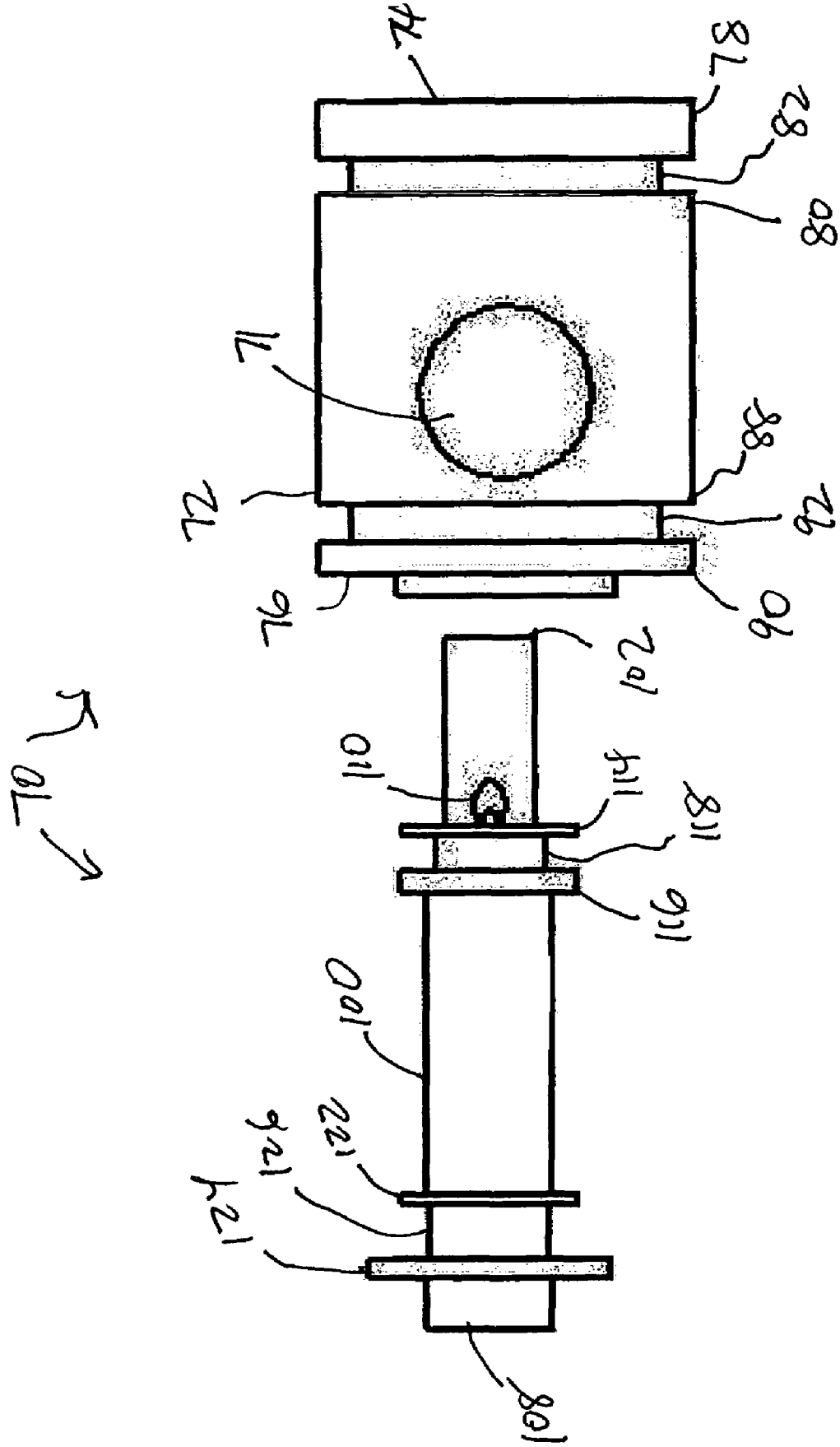
FIG. 13 shows a top plan view of the valve assembly of the present invention shown in FIG. 12, with the valve spool removed from the valve body.
Figure 14:
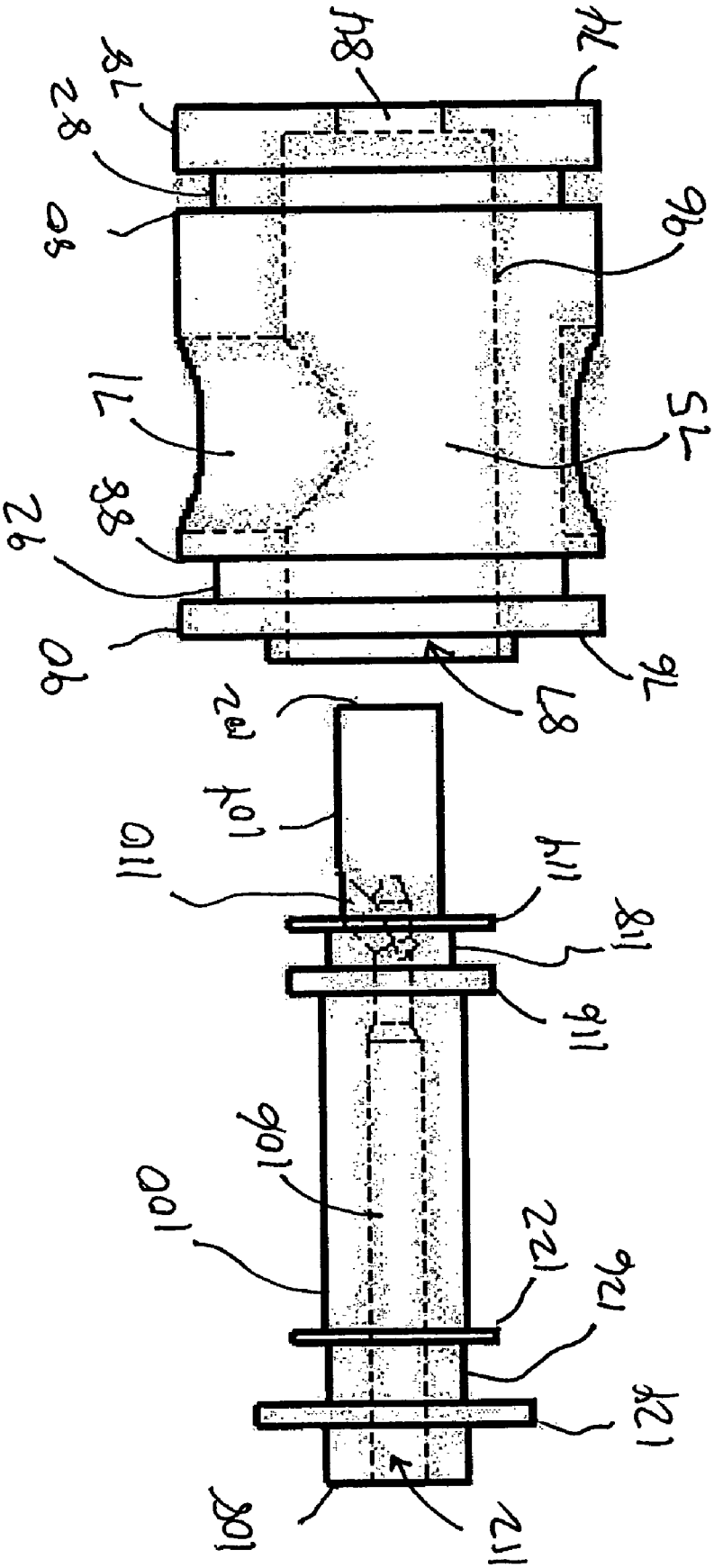
FIG. 14 shows a side plan view of the valve assembly of the present invention shown in FIG. 12, with the valve spool removed from the valve body, showing the compressed gas passages in phantom lines.
Figure 15:
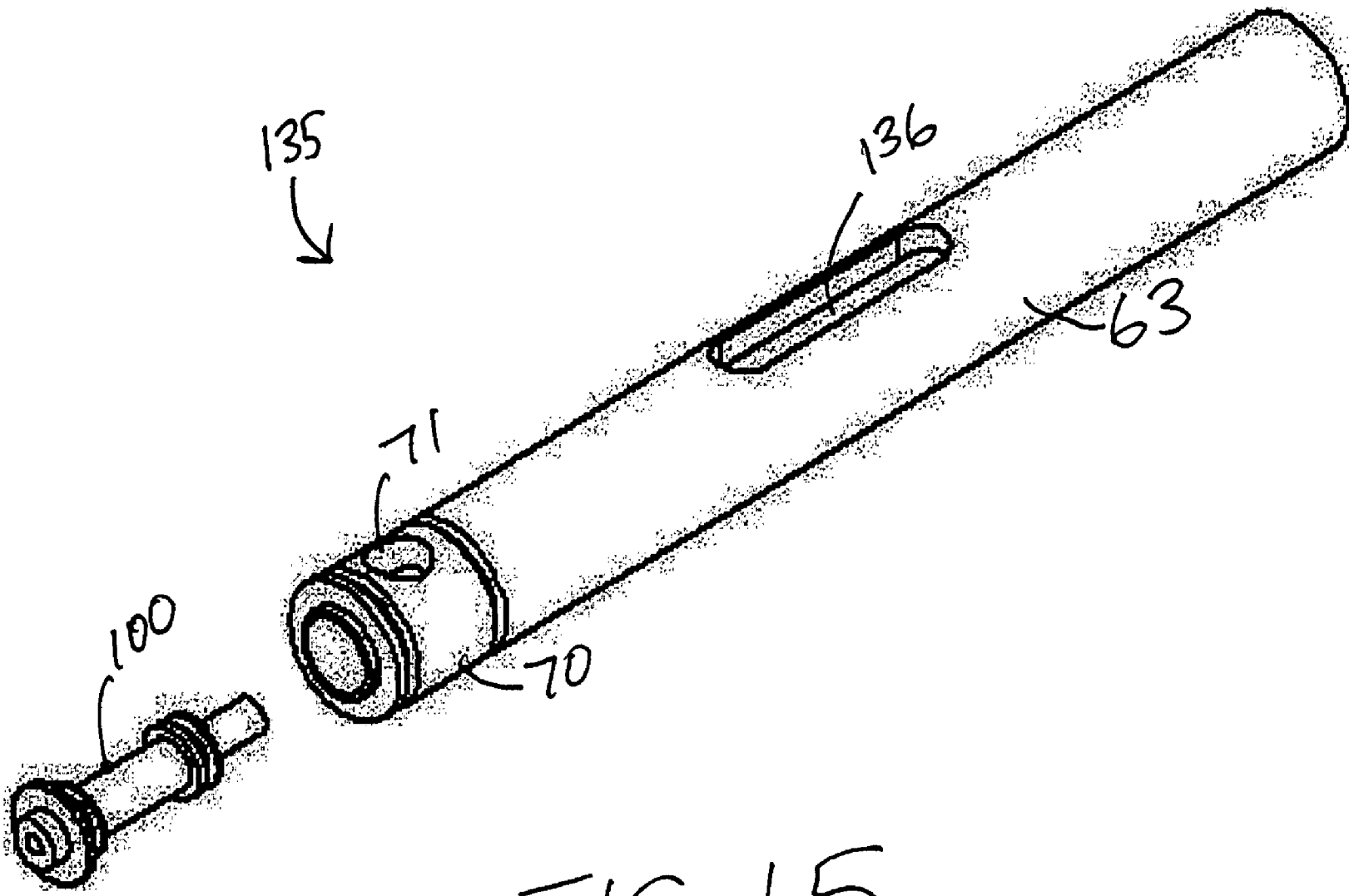
FIG. 15 shows a perspective view of an alternate embodiment of the valve assembly of the present invention with the valve assembly positioned adjacent a pneumatic chamber for a compressed gas gun using pneumatic force to open the valve assembly.
Figure 16:
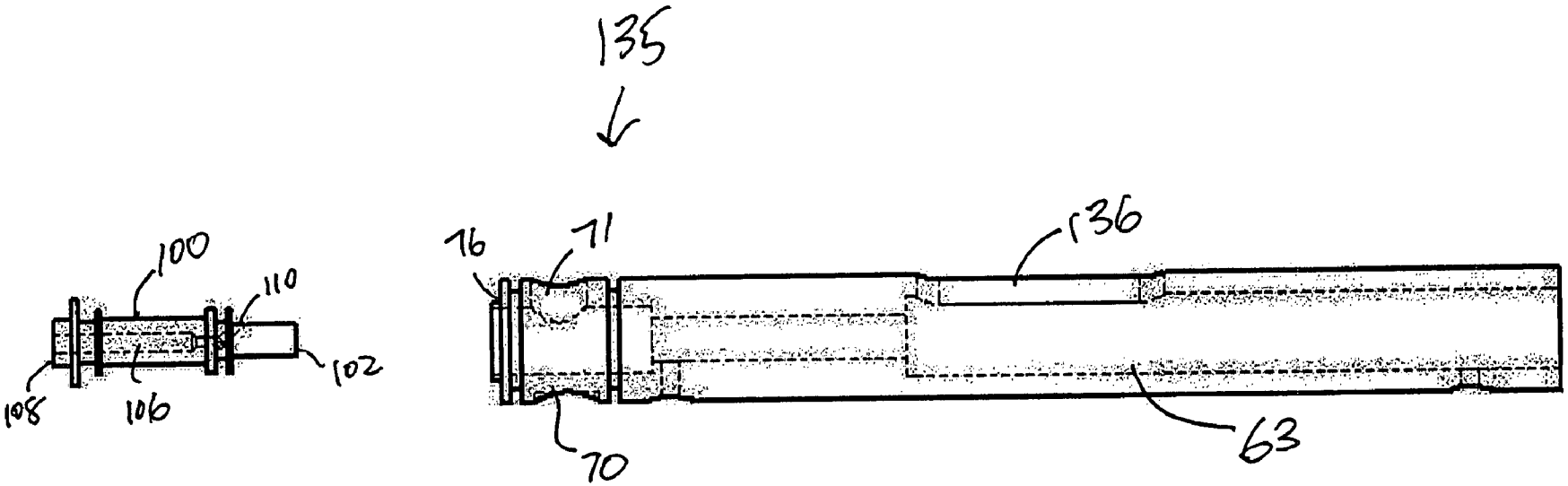
FIG. 16 shows a side plan view of the valves assembly and pneumatic chamber of a compressed gas gun shown in FIG. 15.

As shown in detail in FIGS. 8, 9 & 11, housed at least partially within the interior space 75 of the valve body 72, and moveable from a first or closed position to a second or opened position, is a valve spool 100, having a first or rear end 102 adjacent the rear end 74 of the valve body 70, and a second or forward end 108 adjacent the forward end 76 of the valve body 70. The valve spool 100 has a spool channel 106 running along a length of the valve spool 100, and having an opening 112 adjacent the forward end 108. A secondary spool channel 110 is provided running through a wall of the valve spool 100 and intersecting the spool channel 106. The secondary spool channel 110 provides communication between the spool channel 106 and a gas balance chamber 105, described in greater detail below. When the valve spool 100 is in the opened position, the valve assembly 70 is also considered to be opened, and when the valve spool 100 is in the closed position, the valve assembly 70 is also considered to be closed.

The valve spool 100 includes a first or rear end 102 having a valve stem 104 designed to extend through channel 84 into the hammer portion 50 of the lower chamber 42, for contacting the hammer 52. A first rear spool wall 114 and a second rear spool wall 116 adjacent the rear end 102 of the valve spool 100 define an O-ring receiving space 120. An O-ring 120 is provided in O-ring receiving space 118, to prevent the passage of compressed gas. In a preferred embodiment, the first rear spool wall 114 and a second rear spool wall 116 are formed having diameters which are sized to fit within the interior space 75 of valve body 72, as shown in FIGS. 8-9. The O-ring 120 is sized to provide a snug fit with the inner wall 96 of the valve body 72, to prevent the passage of compressed gas. A gas balance chamber 105 is formed, rearward of the O-ring 120.

The second or forward end 108 of the valve spool 100 includes a first forward spool wall 122 and a second forward spool wall 124, defining an O-ring receiving space 126. An O-ring 128 is provided in O-ring receiving space 126, to prevent the passage of compressed gas. In a preferred embodiment, the first forward spool wall 122 has a diameter sized to fit within the interior space 75 of valve body 72. The O-ring 128 is sized having a diameter that is greater than the diameter of the opening 87 in the forward end 76 of the valve body 72. Thus, when the valve spool 100 is in the closed position, as shown in FIG. 8, the O-ring 128 rests against the outer side of the forward end 76 of the valve body 72. In the closed position, compressed gas would be stopped from flowing from the high pressure chamber 34 to the interior space 75 of the valve body 72.

As shown in FIGS. 8-9, the O-ring 128 is sized to form a first effective surface area adjacent the forward end 108 of the valve spool 100, designated as SA1. A second effective surface area is defined by the area within the gas balance chamber 105, between the O-ring 120, the surface of the valve stem 104 within the valve body 72, and the O-ring 98, designated as SA2. For proper operation of the valve assembly 70 of the present invention, SA1 must be greater than SA2, and the pressure force acting on SA1, must be greater than the pressure force acting on SA2, so that the valve spool 100 is biased by a pressure differential to the closed position, as will be described further below. In a preferred embodiment, the ratio of SA1 to SA2 may be adjusted based upon preference or gun operation, to a ratio whereby the effective surface area of SA1 is approximately 30-50% greater than the effective surface area of SA2. The force required to move the valve spool 100 to an opened position can effectively be selectively controlled by adjusting this ratio.

While the use, sizing and positioning of O-rings as described herein is preferred, it is appreciated that other arrangements may be used to form the first effective surface area SA1, and the second effective surface area SA2, without the use of O-rings. For example, the forward end 108 of the valve spool 100 may be manufactured having an annular wall formed thereon for sealing the opening 112, rather than using an O-ring. Similarly, the rear end 102 of the valve spool 100 may be formed having an annular wall sized to fit within the interior space 75 of the valve body 72, and fit snugly against the inner wall 96 blocking the passage of compressed gas.

As shown in FIGS. 2-7, a valve spring 66 may be provided at least partially within the high pressure chamber 34, and contacts the forward end 108 of the valve spool 100. The valve spring 66 is positioned to bias the valve spool 100 to a closed position, with the O-ring 120 resting against the forward end 76 if the valve body 72.

When the valve assembly 70 of the present invention is positioned within the valve portion of a compressed gas gun 10, 11, the valve assembly operates as follows, with reference to FIGS. 2-7. Compressed gas is initially received from a source of compressed gas within the compressed gas chamber 34. Compressed gas will flow through the opening 112 in valve spool 100, will flow rearward through the spool channel 106, and will flow through the secondary spool channel 110, to the gas balance chamber 105. Due to the greater effective surface area SA1, the force of compressed gas acting on the forward end 108 of the valve spool 100 is greater than the force of compressed gas acting within the gas balance chamber 105 on the effective surface area SA2. The valve spool 100 will be biased by compressed gas force to the closed position in this state, with the O-ring 128 seated against the forward end 76 of the valve body 72. The valve spring 66 will assist in biasing the valve spool 100 to the closed position, however, it is appreciated that a compressed gas gun utilizing the valve assembly of the present invention could formed absent the valve spring 66, without departing from the present invention.

Notably, the valve assembly 70 of the present invention provides a novel arrangement, in that there is a pressure force generated within the gas balance chamber 105 that is in opposition to the pressure force acting on the forward end 76 of the valve body 72. Thus, there is a force generated by the compressed gas within the gas balance chamber 105 acting to bias the valve spool to an open position. This provides significant benefits over known valve assemblies, as will be described below.

In order to fire the compressed gas guns described herein, the trigger 32 must be actuated, by pulling the trigger 32. In the embodiment of a compressed gas gun 10 shown in FIGS. 2-4, where a hammer spring 54 is employed, pulling the trigger 32 releases the sear 62, and the hammer 52 moves to a firing position under the force of the hammer spring 54. In the embodiment of a compressed gas gun 11 shown in FIGS. 5-7, where compressed gas within a pneumatic chamber 63 is employed to move the hammer 52, pulling the trigger 32 will operate a solenoid valve, that will shunt compressed gas from the compressed gas source to the rear portion of the hammer 52, thereby moving the hammer 52 forward to a firing position. Through the mechanical linkage 64, the bolt 18 is similarly moved to a firing position.

In the firing position, as shown in FIGS. 4, 7, the bolt aperture 30 is aligned with firing port 44. Thus, when the valve spool 100 is in the open position, a gas flow passage 47 is formed, providing communication between compressed gas in the high pressure chamber 34, a portion of the valve body interior space 75, the firing port, and the bolt aperture 30.

In the firing position, as shown in FIGS. 4, 7 the hammer striker 53 impacts the valve stem 104. In known valve assemblies, the hammer 52 must impact the valve stem of a poppet valve with enough force to overcome the strong spring bias maintaining the poppet valve in a closed position. According to the present invention, the hammer 52 is assisted in opening the valve spool 100 by the compressed gas accumulated in the gas balance chamber 105. By using the valve assembly of the present invention, the force required to open the valve spool 100 is reduced greatly reduced, and may be selectively controlled by adjusting the ratio of SA1 to SA2.

The hammer striker 53 impacts the valve stem 104, opening the valve spool 100, and therefore opening the gas flow passage 47. Compressed gas flows through the bolt aperture 30 to fire a projectile chambered in the compressed gas gun 10.

Figure 17:
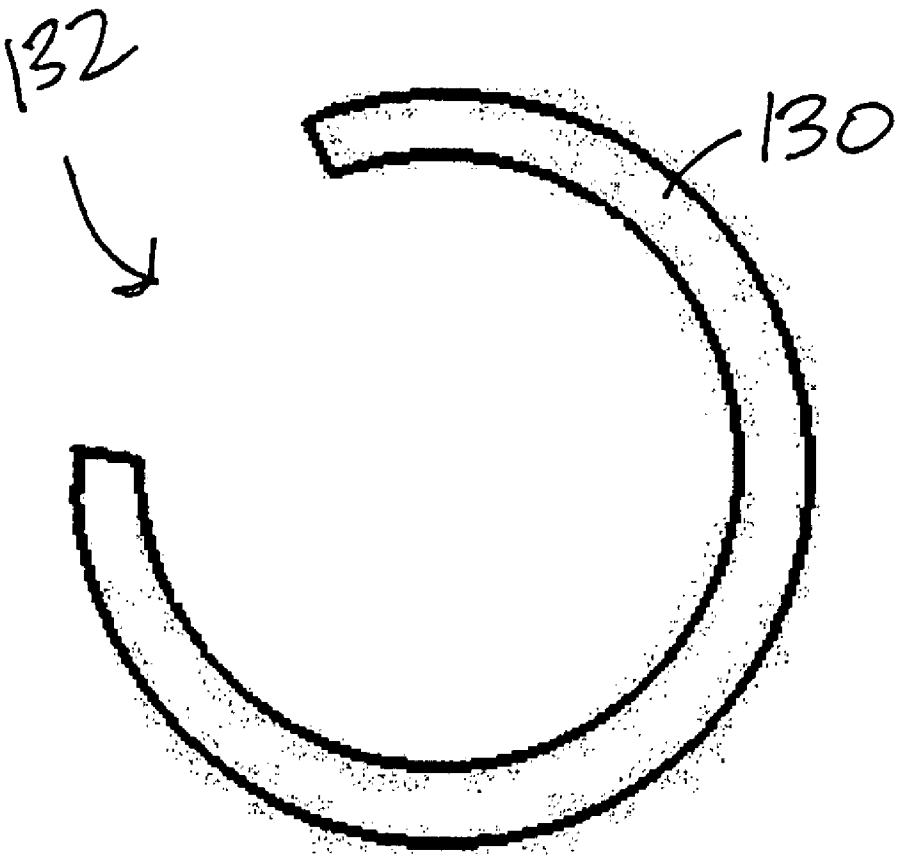
FIG. 17 shows a blow back ring according to the present invention.
Figure 18:
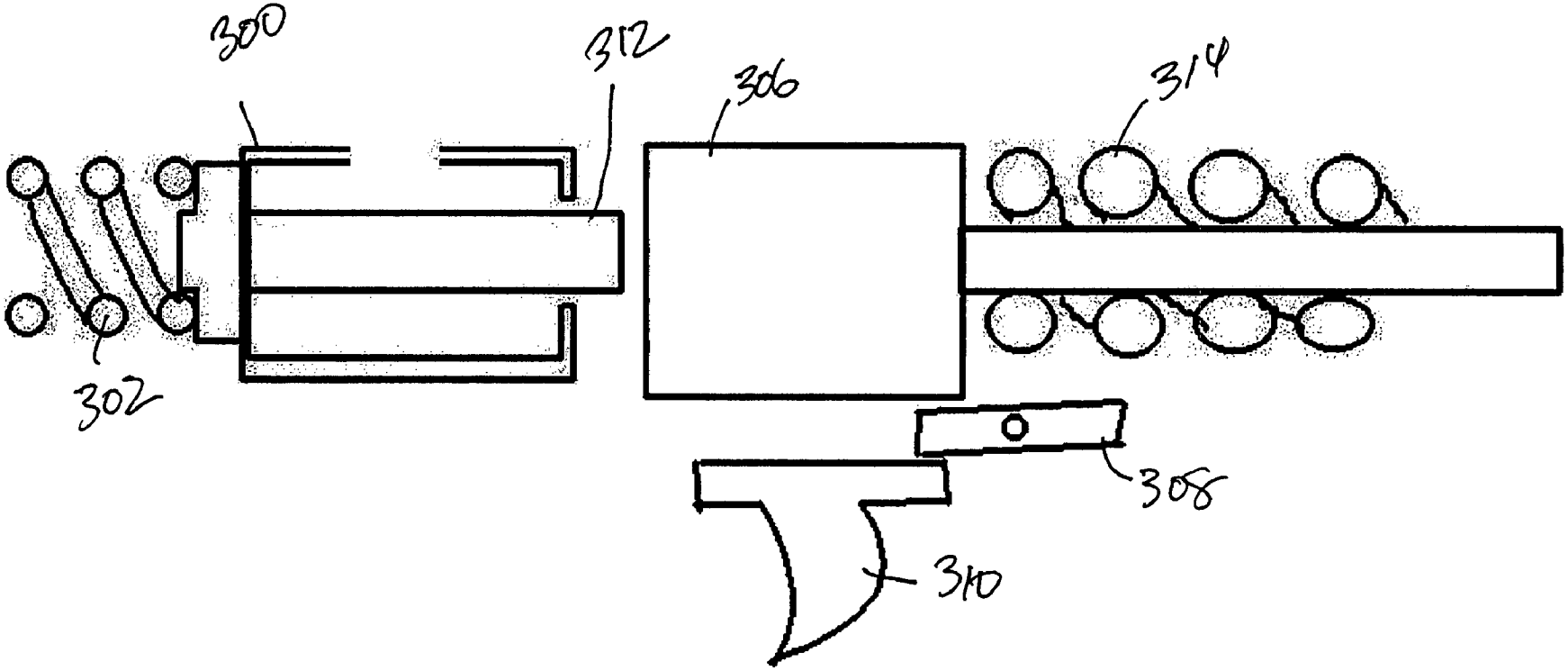
FIG. 18 shows a cross sectional side view of a known poppet valve and hammer assembly for illustrative purposes.

The valve assembly 70 of the present invention further provides a unique method for recocking the hammer 52, that is, returning the hammer 52 and bolt 18 to the loading position. When the hammer 52 strikes the valve stem 104, as compressed gas escapes through the valve aperture 71, a portion of the compressed gas also flows rearward around the valve body 72. The O-ring 83 may be formed as a "blow back" ring 130, or piston ring, as shown in FIG. 17. The blow back ring 130 has an opening segment 132 that allows the passage of compressed gas to blow back the hammer 52 to a loading position. In an alternate embodiment, the O-ring 83 may be sized to provide a space between the O-ring and the valve portion 56 the lower chamber 42 allowing the passage of compressed gas around the rear end 74 of the valve body 72. In operation, compressed gas will "blow back" the hammer 52 to the loading position, and thus return the bolt 18 to the loading position, whereby another projectile can be chambered in the breech 16. The entire cycle, from pulling the trigger, to the hammer returning to the first position, is considered a firing operation.

Once the hammer striker 53 impacts the valve stem 104, the spring energy from the hammer spring 54 moving the hammer 52 to the firing position dissipates. In order to close the valve assembly 70, the force of the valve spring 66 and the force of compressed gas on the forward end 108 of the valve spool 100 overcome the opposing force generated by compressed gas in the gas balance chamber 105, and any remaining opposing force generated by the hammer 52. When the force of the valve spring 66 and compressed gas from the high pressure chamber 34 is greater than any opposing forces, the valve assembly 70 will close.

In some known high-end performance guns, the hammer 52 is returned to the loading position by a spring located at the forward end of the hammer portion 50 of the lower chamber 42. In that case, the O-ring 83 may be sized to block the passage of compressed gas from the valve portion 56 of the lower chamber 42 to the hammer portion 50 of the lower chamber.

In known compressed gas guns, the amount of blow back gas for recocking the hammer 52 is not controlled, and is usually much more than is required to recock the hammer 52, and excess compressed gas is vented to atmosphere. Using the configuration of the present invention will increase efficiency and save compressed gas, thus allowing a user of a compressed gas gun to use less gas tanks.

The size of the opening segment 132 in the blow back ring 130 may be adjusted to take into consideration the operating characteristics of the various compressed gas guns. Various considerations such as gun weight, hammer weight, spring forces, can be examined to determine the optimal size of the opening segment 132. Any adjustments may be made to vary the hammer and bolt performance. Thus, the valve assembly of the present invention may be customized and optimized in a very efficient manner.

The valve assembly of the present invention provides several advantages over known poppet valve and other designs. In a compressed gas gun utilizing a hammer spring to move the hammer, by using a valve assembly of the present invention, the hammer spring force necessary to open the valve assembly is greatly reduced, since compressed gas is used to assist in opening the valve spool. In compressed gas guns utilizing electronics to disengage the sear from the hammer for firing, less load and electrical requirements are need, increasing battery life. Due to the characteristics of the valve assembly of the present invention, the compressed gas gun is quieter in operation during firing. Compressed gas flow can be increased, as the forward end of the valve spool can be larger than in known compressed gas gun valve assemblies.

In addition, the size of the opening 87 may be increased compared to known valve assemblies, allowing greater gas flow for firing projectiles. The increased diameter of the opening 87 results in increased gas flow to the gas flow passage and bolt.

Although the valve assembly of the present invention is illustrated operating a "over/under" or "two-tube" compressed gas gun, which are considered to be of the "open bolt" design as is known in the art, it is appreciated that the valve assembly of the present invention may be used to replace the valve assemblies in known "closed bolt" style compressed gas guns. In the "closed bolt" style compressed gas gun, the bolt and hammer move independently. However, the hammer still impacts a valve assembly to fire the compressed gas gun. Exemplary closed bolt style compressed gas guns are shown in U.S. Pat. No. 6,561,176, and U.S. Pat. No. 5,890,479. The valve assembly of the present invention may replace the firing valve assemblies of a closed bolt compressed gas gun, and provide the advantages outlined herein.

The valve assembly 70 of the present invention may be offered as a replacement part for existing compressed gas guns. Thus, as shown in FIGS. 12-16, the valve assembly 70 of the present invention may be offered in a "drop in" or "plug and play" manner, to increase the efficiency and operation of existing compressed gas guns. For example, the embodiment shown in FIGS. 15 & 16 could be offered as a drop in type replacement 135 to replace the valve assemblies of either spring hammer operated compressed gas guns, or pneumatically operated compressed gas guns having poppet valves. Such a replacement 135 could also convert a compressed gas gun operating by a hammer spring, with a pneumatic chamber and pneumatic operation in conjunction with the valve assembly 70 of the present invention. The pneumatic chamber 63 shown in FIGS. 15 & 16 may be sized to fit within the hammer portion of the lower chamber of known compressed gas guns. The pneumatic chamber 63 may be formed with an opening 136 allowing the mechanical linkage 64 to be attached to the a hammer disposed in the pneumatic chamber 63.

Having thus described in detail several embodiments of the present invention, it is to be appreciated and will be apparent to those skilled in the art that many physical changes, only a few of which are exemplified in the detailed description of the invention, could be made without altering the inventive concepts and principles embodied therein. It is also to be appreciated that numerous embodiments incorporating only part of the preferred embodiment are possible which do not alter, with respect to those parts, the inventive concepts and principles embodied therein. The present embodiment and optional configurations are therefore to be considered in all respects as exemplary and/or illustrative and not restrictive, the scope of the invention being indicated by the appended claims rather than by the foregoing description, and all alternate embodiments and changes to this embodiment which come within the meaning and range of equivalency of said claims are therefore to be embraced therein.

What is claimed is:

1. A compressed gas gun comprising:

a gun body;

a trigger;

an upper chamber housing a bolt, the bolt moveable from a loading position to a firing position, the bolt having an aperture therethrough;

a lower chamber comprising a valve assembly comprising:

a high pressure chamber;

a valve portion intermediate the high pressure chamber and a hammer portion of the lower chamber, the hammer portion of the lower chamber including a hammer moveably from a loading position adjacent a rear portion of the gun body to a firing position adjacent the valve portion of the lower chamber;

a valve assembly provided in the valve portion of the lower chamber, the valve assembly comprising:

a valve body defining an interior space having a first end with a channel therethrough and an opposite second end with an opening therethrough, and a valve aperture intermediate the first end and the second end;

a valve spool having a portion disposed within the housing, and forming a gas balance chamber within the interior space adjacent the first end of the valve body, the valve spool having a stem extending through the channel in the valve body, the valve spool having a second end opposite the first end positioned adjacent the outer side of the second end of the valve body, the second end of the valve spool sized to close the opening in the second end of the valve body, and, a channel running through the valve spool and providing communication with the second end of the valve spool and the gas balance chamber;

wherein the second end of the spool valve has an effective surface area greater than the effective surface area of the gas balance chamber; and, a trigger for initiating a firing operation of the compressed gas gun, wherein actuating the trigger causes the hammer to strike the stem of the valve spool.

2. The compressed gas gun of claim 1, wherein the second end of the valve spool includes an O-ring adapted to close the opening in the valve body and prevent the passage of compressed gas from a compressed gas source.

3. The compressed gas gun of claim 1, wherein the first end of the valve spool includes an O-ring for blocking the passage of compressed gas supplied by a compressed gas source.

4. The compressed gas gun of claim 1, further comprising a hammer spring in the hammer portion of the lower chamber biasing the hammer toward the firing position, further comprising a sear adapted to hold the hammer against spring bias in a loading position, the sear actuated by the trigger.

5. The compressed gas gun of claim 1, further comprising a pneumatic chamber disposed in the rear portion of the lower chamber, a portion of the hammer disposed within the pneumatic chamber, the compressed gas gun adapted to supply compressed gas to the pneumatic chamber to move the hammer from a loading position to a firing position upon actuation of the trigger.

6. The compressed gas gun of claim 1, further comprising a blow back ring positioned on the valve body adjacent the first end of the valve body.

* * * * *

UNITED STATES PATENT AND TRADEMARK OFFICE

CERTIFICATE OF CORRECTION

PATENT NO. : 7,624,726 B2
APPLICATION NO. : 11/180506
DATED : December 1, 2009
INVENTOR(S) : Michael J. Wood It is certified that error appears in the above-identified patent and that said Letters Patent is hereby corrected as shown below:

ON THE TITLE PAGE

Item (56), U.S. PATENT DOCUMENTS, page 1, left column, after line beginning with "2,881,752" insert --3,000,399 A 9/1961 Brukner--.

Item (56), U.S. PATENT DOCUMENTS, page 1, left column, after line beginning with "3,572,310" insert --3,584,646 A 6/1971 Olmsted--.

Item (56), U.S. PATENT DOCUMENTS, page 1, right column, after line beginning with "3,888,159" insert --3,917,760 A 11/1975 Swatman--.

Item (56), U.S. PATENT DOCUMENTS, page 2, left column, after line beginning with "4,819,610" insert --4,926,906 A 5/1990 Ichihashi et al.--.

Item (56), U.S. PATENT DOCUMENTS, page 2, right column, after line beginning with "2004/0216728" insert --2005/0067031 A1 3/2005 Lee--.

Item (56), U.S. PATENT DOCUMENTS, page 2, right column, after line beginning with "2005/0115550" insert --2005/0235976 A1 10/2005 Carnall--.

Item (56), U.S. PATENT DOCUMENTS, page 2, right column, after line beginning with "2006/0011185" insert --2007/0181115 A1 8/2007 Jong
2008/0011284 A1 1/2008 Styles et al.--.

At column 1, line 43, after the word "valve" insert --.--.

At column 2, line 19, after the word "enough", insert --to--.

At column 3, line 21, after the words "view of", delete "thevalve" and insert therefor --the valve--.

Signed and Sealed this
Twenty-eighth Day of June, 2011

David J. Kappos

David J. Kappos
*Director of the United States Patent and Trademark Office*

At column 3, line 43, after the words “of the”, delete “valves” and insert therefor --valve--.

At column 5, line 3, after the word “rearward”, insert --of--.

At column 7, line 2, before the words “the valve”, delete “if” and insert therefor --of--.

At column 7, line 22, after the word “could”, insert --be--.

At column 7, line 64, before the word “greatly” delete “reduced”.

At column 8, line 66, after the word “are”, delete “need,” and insert therefor --needed,--.

At column 9, line 11, after the word “operating”, delete “a” and insert therefor --an--.